US009609936B2

(12) United States Patent
Kim et al.

(10) Patent No.: US 9,609,936 B2
(45) Date of Patent: Apr. 4, 2017

(54) CREAM-TYPE COSMETIC CONTAINER

(71) Applicant: YONWOO CO., LTD., Incheon (KR)

(72) Inventors: Hak-Chan Kim, Incheon (KR); Shin-Bok Jung, Incheon (KR); Sung-Woo Cheon, Incheon (KR); Seo-Hui Jung, Incheon (KR); Hyo-Sun Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 163 days.

(21) Appl. No.: 14/408,148

(22) PCT Filed: Dec. 24, 2013

(86) PCT No.: PCT/KR2013/012090

§ 371 (c)(1),
(2) Date: Dec. 15, 2014

(87) PCT Pub. No.: WO2015/088091

PCT Pub. Date: Jun. 18, 2015

(65) Prior Publication Data

US 2016/0262523 A1 Sep. 15, 2016

(30) Foreign Application Priority Data

Dec. 12, 2013 (KR) ..... 10-2013-0154482

(51) Int. Cl.
*A45D 40/00* (2006.01)
*B65D 83/00* (2006.01)
(Continued)

(52) U.S. Cl.
CPC ..... *A45D 40/0075* (2013.01); *A45D 34/00* (2013.01); *A45D 40/00* (2013.01);
(Continued)

(58) Field of Classification Search
CPC ..... A45D 40/0075; B05B 11/3052; B05B 11/3067
(Continued)

(56) References Cited

U.S. PATENT DOCUMENTS 3,820,689 A * 6/1974 Cocita ..... B05B 11/3032 222/207
5,099,885 A * 3/1992 Nilsson ..... B05B 11/3032 137/852
(Continued)

FOREIGN PATENT DOCUMENTS

KR 10-1028988 B1 4/2011
KR 10-2012-0138690 A 12/2012
(Continued)

OTHER PUBLICATIONS

International Search Report issued in PCT/KR2013/012090 mailed on Sep. 26, 2014.
(Continued)

*Primary Examiner* — Donnell Long
(74) *Attorney, Agent, or Firm* — Marshall, Gerstein & Borun LLP

(57) ABSTRACT

Provided is a cream-type cosmetic container, which can easily discharge a highly viscous content without a separate pumping member by allowing a button part to downwardly move and then return to an original location and thus changing the internal pressure of the container body when a user pressurizes the button part, and thus can save the assembling time and the manufacturing cost.

2 Claims, 2 Drawing Sheets

(51) Int. Cl.
*A45D 34/00* (2006.01)
*B05B 11/00* (2006.01)

(52) U.S. Cl.
CPC ..... *B05B 11/3032* (2013.01); *B05B 11/3052* (2013.01); *B05B 11/3067* (2013.01); *B65D 83/0033* (2013.01); *A45D 2200/055* (2013.01); *B05B 11/0037* (2013.01); *B05B 11/0048* (2013.01)

(58) Field of Classification Search
USPC .... 222/380, 383.1, 386, 387, 425, 448, 449, 222/450, 207, 209, 212
See application file for complete search history.

(56) References Cited

U.S. PATENT DOCUMENTS 5,301,850 A * 4/1994 Gueret ..... A45D 34/04 222/321.3
6,789,706 B2 * 9/2004 Abergel ..... B05B 11/0043 222/207
7,997,454 B2 * 8/2011 LaFlamme ..... A45D 34/04 222/207
8,109,412 B2 * 2/2012 Decottignies ..... B65D 83/28 222/108
2009/0166383 A1 * 7/2009 Canfield ..... A45D 34/04 222/207
2009/0302064 A1 * 12/2009 Lavabre ..... B05B 11/0018 222/207
2010/0276456 A1 * 11/2010 Corbin ..... B05B 11/0024 222/205
2012/0006853 A1 * 1/2012 Lim ..... A45D 40/0075 222/256

FOREIGN PATENT DOCUMENTS

KR 10-2013-0013135 A 2/2013
WO WO-2010-050772 A2 5/2010

OTHER PUBLICATIONS

Written Opinion issued in PCT/KR2013/012090 mailed on Sep. 26, 2014.

* cited by examiner (a) (b)

CREAM-TYPE COSMETIC CONTAINER

CROSS-REFERENCE TO RELATED APPLICATIONS

This application is a national phase application of PCT/KR2013/012090, filed Dec. 24, 2013, and claims the benefit of priority of Korean application 10-2013-0154482, filed Dec. 12, 2013, which is hereby incorporated by reference herein in its entirety for all purposes.

TECHNICAL FIELD

The present invention disclosed herein relates to a cream-type cosmetic container, and more particularly, to a cream-type cosmetic container, which can easily discharge a highly viscous content without a separate pumping member by allowing a button part to downwardly move and then return to an original location and thus changing the internal pressure of the container body when a user pressurizes the button part, and thus can save the assembling time and the manufacturing cost.

BACKGROUND

Generally, cream-type cosmetic containers storing highly viscous cream are configured to interrupt a contact between air and the content contained in the cosmetic containers. An exemplary vacuum-type cosmetic container is disclosed in Korean Utility Model No. 20-0311503 filed and owned by the present applicant.

This utility model discloses a dispenser container including a container part 10 storing contents, a dispenser 100 coupled to an upper end of the container part 10. The dispenser 100 includes a cylinder 20 coupled to the upper end of the container part 10, a valve body 30 disposed at an intake hole 22 of the cylinder 20, a button 40 disposed at the cylinder 20 so as to perform repetitive pumping and including a tray part 42 extended so as to cover an upper part of the container part 10 at an upper end thereof, and a piston 50 disposed between an inner wall surface of the cylinder 20 and a lower end portion of the button 40. Here, the button has a slide hole 44 formed at a central portion thereof in a vertical direction, and the valve body 30 has an upper end thereof upwardly extending and slidably inserted into the slide hole 44 of the button. Also, a cover member 60 is coupled to the upper end of the valve body 30 to cover the slide hole 44 of the button 40. Thus, when the button 40 is pushed, the button 40 descends along an outer circumferential surface of the valve body 30, generating a gap between the cover member 60 and the button 40. Contents are discharged through the gap and collect in the tray part 42 of the button 40.

However, in this utility model, the dispenser 100 including the cylinder 20 having the intake hole 22 at the lower end thereof is coupled to the upper portion of the container part 10 to discharge contents stored in the container part 10. Accordingly, since this utility model has a structure in which pumping is performed through the dispenser 100 having a complicated structure, there is a limitation in that the assembling time and the manufacturing cost for installing the dispenser 100 increase.

SUMMARY

The present invention provides a cream-type cosmetic container, which can easily discharge a highly viscous content without a separate pumping member by allowing a button part to downwardly move and then return to an original location and thus changing the internal pressure of the container body when a user pressurizes the button part, and thus can save the assembling time and the manufacturing cost.

The present invention also provides a cream-type cosmetic container, which can discharge a uniform amount of contents every pumping operation by suctioning and storing a uniform amount of contents in a space defined by a pumping guide cap and a content suctioning part through the content suctioning part.

Embodiments of the present invention provide cream-type cosmetic containers including: a container body containing contents and having a volume reduced according to a use of contents; a pumping guide cap coupled to an upper portion of the container body, elastically deformed according a pressurization by a user, and discharging contents contained in the container body by a pumping operation; and a content suctioning part disposed inside the container body, coupled to a lower portion of the pumping guide cap to form a space for storing contents, and suctioning a uniform amount of contents contained in the container body by an elastic deformation of the pumping guide cap.

In some embodiments, the pumping guide cap may include a button part disposed at one side of an upper end of the pumping guide cap, downwardly moved and then restored to an original location according to the pressurization of a user, guiding the pumping operation by changing a pressure of the space defined by the pumping guide cap and the content suctioning part, and formed of an elastic material.

In other embodiments, the pumping guide cap may further include: a coupling part coupled to the upper portion of the container body to fix the pumping guide cap to the container body; and a content outlet hole located at the other side of the upper end of the pumping guide cap and discharging contents according to an operation of the button part.

In still other embodiments, the cream-type cosmetic container may include a first valve member disposed in the content outlet hole to open/close the content outlet hole according to the pressurization of a user.

In even other embodiments, the content suctioning part may have a content inlet hole for allowing contents stored in the container body to flow therethrough, and may include a second valve member disposed in the content inlet hole to open/close the content inlet hole according to the pressurization of the button part.

In yet other embodiments, the cream-type cosmetic container may further include a closing cap coupled to the upper portion of the container body while covering the pumping guide cap.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings

DETAILED DESCRIPTION

Figure 1:
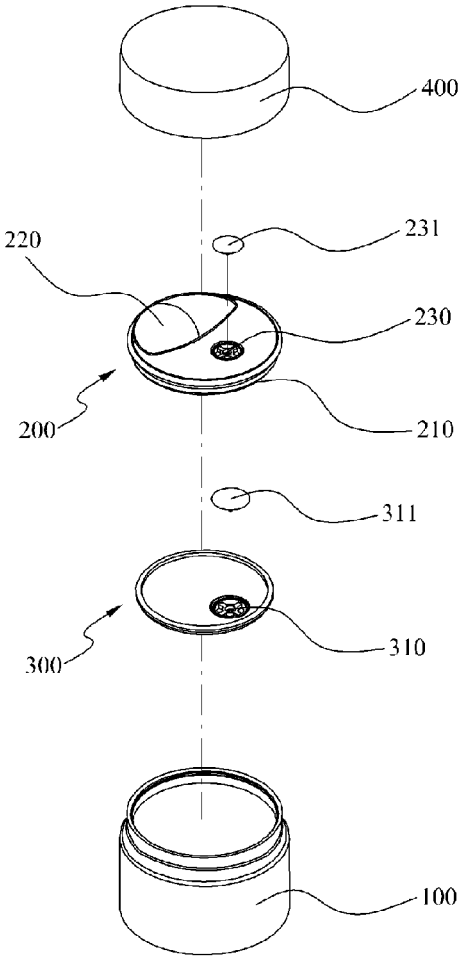
FIG. 1 is an exploded perspective view illustrating a configuration of a cream-type cosmetic container according to an exemplary embodiment of the present invention.

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, exemplary embodiments of the present invention will be described in detail with reference to the accompanying drawings. The same reference numerals provided in the drawings indicate the same members.

Figure 2:
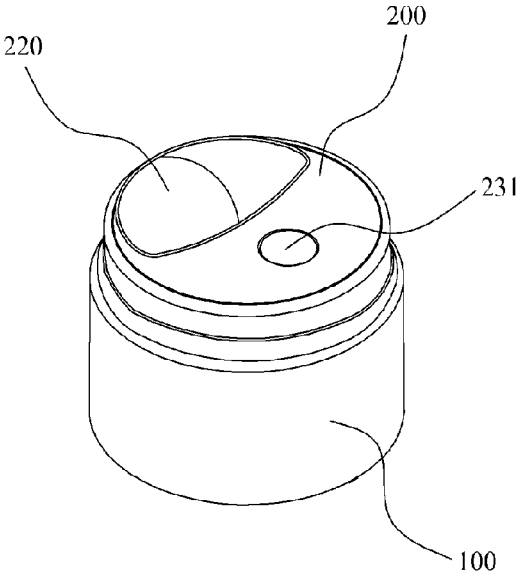
FIG. 2 is an assembled perspective view illustrating a configuration of a cream-type cosmetic container according to an exemplary embodiment of the present invention.
Figure 3:
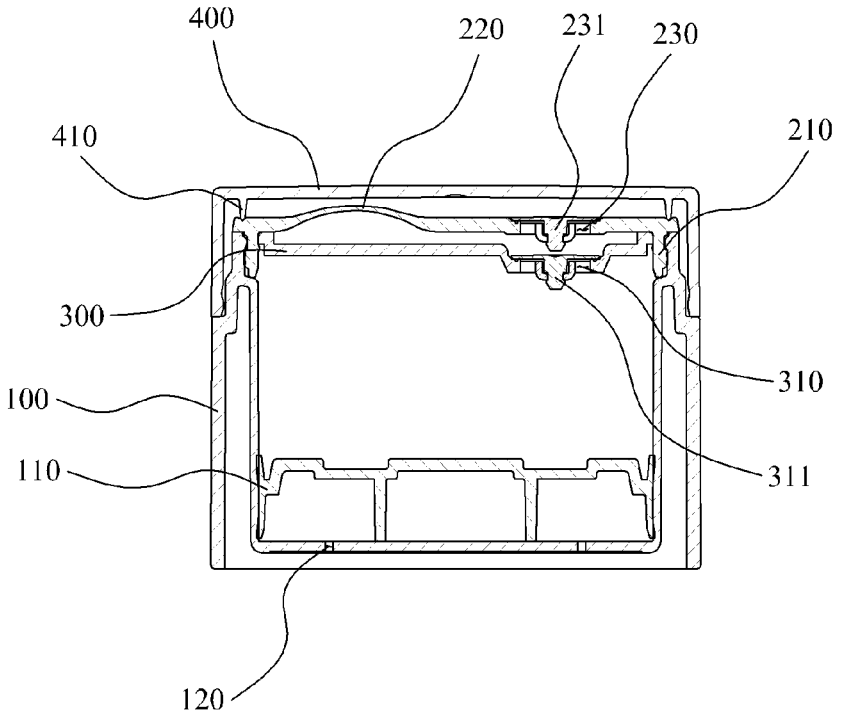
FIG. 3 is an assembled cross-sectional view illustrating a configuration of a cream-type cosmetic container according to an exemplary embodiment of the present invention.

FIG. 1 is an exploded perspective view illustrating a configuration of a cream-type cosmetic container according to an exemplary embodiment of the present invention. FIG. 2 is an assembled perspective view illustrating a configuration of a cream-type cosmetic container according to an exemplary embodiment of the present invention. FIG. 3 is an assembled cross-sectional view illustrating a configuration of a cream-type cosmetic container according to an exemplary embodiment of the present invention.

Referring to FIGS. 1 to 3, a cream-type cosmetic container according to an exemplary embodiment of the present invention may include a container body 100, a pumping guide cap 200, a content suctioning part 300, and a closing cap 400.

The container body 100 may contain contents, and may include a piston 110 rising according to the use of contents stored in the container body 100.

An air inflow hole 120 may be formed at a lower end portion of the container body 100 to allow air to flow into the container body 100 when the piston 110 rises by a pumping operation through an operation of the pumping guide cap 200.

The pumping guide cap 200 may be coupled to an upper portion of the container body 100 to close an upper opening of the container body 100. The pumping guide cap 200 may include a coupling part 210 coupled to the upper portion of the container body 100 so as to fix the pumping guide cap 200 to the upper portion of the container body 100.

In an embodiment, the pumping guide cap 200 may include a button part 220 at one side of the upper end thereof. The button part 220 may be elastically deformed according to a pressurization of a user, and may change a pressure of a space defined by the pumping guide cap 200 and the content suctioning part 300 described later to discharge contents out of the content suctioning part 300. When a user pressurizes the upper end portion of the button part 220, the whole of the top surface of the button part 220 may downwardly move. Then, when the pressurization of a user is released, the whole of the top surface of the button part 220 may be restored to the original location, changing the pressure of the space defined by the content suctioning part 300 and the pumping guide cap 200 and thus guiding a pumping operation. Accordingly, the button part 220 may be formed of an elastic material so as to enable the elastic deformation according to the pressurization of a user.

The pumping guide cap 200 may have a content outlet hole 230 at the other side of the upper end of the pumping guide cap 220 so as to discharge contents by the pumping operation according to the manipulation of the button part 220. Also, a first valve member 231 may be disposed in the content outlet hole 230 to open/close the content outlet hole 230 according to whether or not the button part 220 is pressurized.

The content suctioning part 300 may be coupled to a lower portion of the pumping guide cap 200 inside the container body 100, and may suction a uniform amount of contents stored in the container body 100 due to the elastic deformation of the button part 220 of the pumping guide cap 200. The content suctioning part 300 may be spaced from the pumping guide cap 200 thereover by a certain interval so as to suction and store contents stored in the container body 100.

Also, the content suctioning part 300 may have a content inlet hole 310 such that contents stored in the container body 100 flow into the content suctioning part 300. Also, a second valve member 311 may be disposed in the content inlet hole 310 to open/close the content inlet hole 310 according to whether or not the button part 220 is pressurized.

The content suctioning part 300 may suction and store a uniform amount of contents contained in the container body 100, and may be guided so as to discharge a uniform amount of contents upon pumping operation according to the manipulation of the button part 220.

The closing cap 400 may be coupled to the upper portion of the container body 100 while covering the pumping guide cap 200. The closing cap 400 may prevent a malfunction of the button part 220, and may protect the first valve member 231 from an external shock.

The closing cap may have a pressurization protrusion 410 formed on an upper end inside the closing cap 400 and pressurizing the upper end of the pumping guide cap 200 to prevent the pumping guide cap 200 from being separated from the container body 100.

Figure 4:
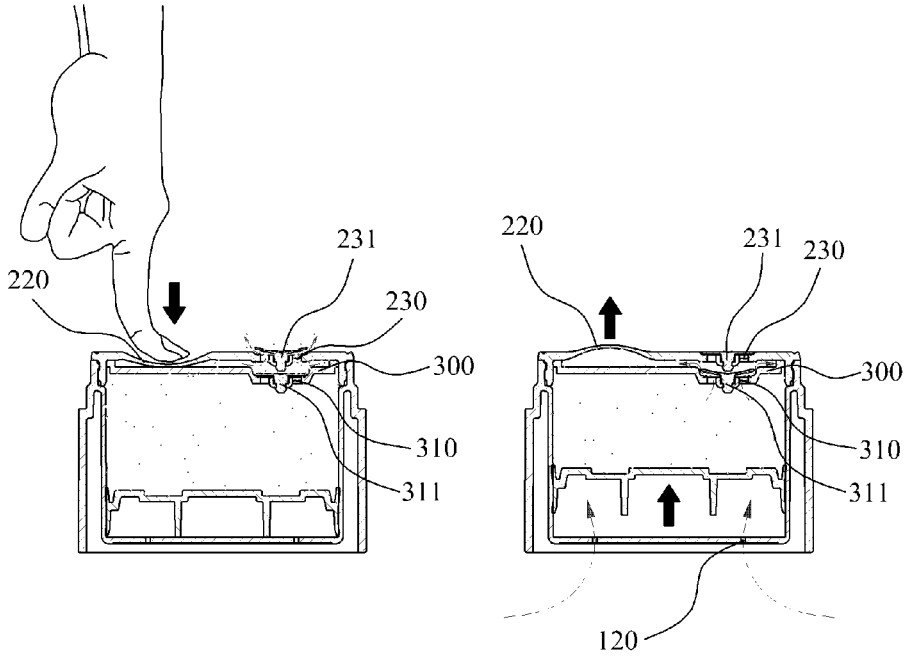
FIG. 4 is a view illustrating an operational state of a cream-type cosmetic container according to an exemplary embodiment of the present invention.

Hereinafter, an operational state of a cream-type cosmetic container according to an exemplary embodiment of the present invention will be described with reference to FIG. 4. FIG. 4 is a view illustrating an operational state of a cream-type cosmetic container according to an exemplary embodiment of the present invention.

Referring to FIG. 4, in an cream-type cosmetic container according to an exemplary embodiment of the present invention, when a user pressurize the button part 220 formed at one side of the pumping guide cap 200, the button part 220 formed of an elastic material may downwardly move, and thus, contents stored in the space defined by the pumping guide cap 200 and the content suctioning part 300 may be discharged to the upper surface of the pumping guide cap 200 through the content outlet hole 230 formed at the other side of the pumping guide cap 200 due to a pressure generated in the space defined by the pumping guide cap 200 and the content suctioning part 300. In this case, the first valve member 231 closing the content outlet hole 230 may open the content outlet hole by the pressure of contents, and the second valve member 311 may close the content inlet hole so as to allowing contents suctioned into the content suctioning part 300 to be discharged through the content outlet hole 230.

When a user depressurizes the button part 220, the button part 220 may be restored and upwardly moved by a self-elastic force. Thus, contents contained in the container body 100 may flow into the content suctioning part 300 by the pressure generated in the space defined by the pumping guide cap 200 and the content suctioning part 300. In this case, the first valve member 231 may close the content outlet hole 230, and the second valve member 311 may open the content inlet hole 310, allowing a uniform amount of contents dischargeable upon next pumping operation to flow into the content suctioning part 300 through the content inflow hole 310.

As described above, since the present invention is configured to store a uniform amount of contents in the space defined by the pumping guide cap 200 and the content suctioning part 300, it is possible to discharge a uniform amount of contents upon pumping operation according to the manipulation of the button part 220.

As described above, the present invention can easily discharge a highly viscous content without a separate pumping member by allowing a button part to downwardly move and then return to an original location and thus changing the internal pressure of the container body when a user pressurizes the button part, and thus can save the assembling time and the manufacturing cost.

Also, the present invention can discharge a uniform amount of contents every pumping operation by suctioning and storing a uniform amount of contents in a space defined by a pumping guide cap and a content suctioning part through the content suctioning part.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Therefore, those skilled in the art will appreciate that various modifications and other equivalent embodiments are possible from the above embodiments. Therefore, the scope of the present invention should be defined by the technical spirit of the accompanying claims.

What is claimed is:

1. A cream-type cosmetic container comprising:

a container body containing contents and having a volume reduced according to a use of contents;

a pumping guide cap coupled to an upper portion of the container body, elastically deformable according to a pressurization by a user, and configured to discharge contents contained in the container body by a pumping operation; and a content suctioning part disposed inside the container body, the content suctioning part coupled to a lower portion of the pumping guide cap to form a space for storing contents, and configured to suction a uniform amount of contents contained in the container body by an elastic deformation of the pumping guide cap, wherein the pumping guide cap comprises a button part formed of an elastic material and disposed at one side of an upper end of the pumping guide cap, the button part being downwardly movable and then restored to an original location according to the pressurization of the user, the button configured to guide the pumping operation by changing a pressure of the space defined by the pumping guide cap and the content suctioning part, wherein the pumping guide cap further comprises:

a coupling part coupled to the upper portion of the container body to fix the pumping guide cap to the container body; and a content outlet hole located at the other side of the upper end of the pumping guide cap, the content outlet hole arranged to discharge the contents according to an operation of the button part, wherein a first valve member is disposed in the content outlet hole to open or close the content outlet hole according to the pressurization of the user, wherein the content suctioning part has a content inlet hole for allowing contents stored in the container body to flow therethrough, the content suctioning part comprising a second valve member disposed in the content inlet hole to open or close the content inlet hole according to the pressurization of the button part, the second valve member located below the first valve member.

2. The cream-type cosmetic container of claim 1, further comprising a closing cap coupled to the upper portion of the container body while covering the pumping guide cap.

* * * * *